US010697210B2

(12) United States Patent
Hiramoto

(10) Patent No.: US 10,697,210 B2
(45) Date of Patent: Jun. 30, 2020

(54) VEHICLE-DOOR OPENING AND CLOSING DEVICE

(71) Applicant: MITSUI KINZOKU ACT CORPORATION, Yokohama-shi, Kanagawa (JP)

(72) Inventor: Shigenori Hiramoto, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 671 days.

(21) Appl. No.: 15/445,439

(22) Filed: Feb. 28, 2017

(65) Prior Publication Data

US 2017/0268265 A1 Sep. 21, 2017

(30) Foreign Application Priority Data

Mar. 16, 2016 (JP) ..... 2016-053167

(51) Int. Cl.

*E05B 81/20* (2014.01)
*E05B 83/40* (2014.01)
*E05B 81/74* (2014.01)
*E05B 81/90* (2014.01)
(Continued)

(52) U.S. Cl.

CPC ..... *E05B 81/20* (2013.01); *E05B 81/74* (2013.01); *E05B 81/90* (2013.01); *E05B 83/40* (2013.01); *E05B 79/20* (2013.01); *E05B 81/06* (2013.01)

(58) Field of Classification Search

None

See application file for complete search history.

(56) References Cited

U.S. PATENT DOCUMENTS 5,445,326 A * 8/1995 Ferro ..... E05B 79/20 292/203
9,228,678 B2 1/2016 Higashi et al.
(Continued)

FOREIGN PATENT DOCUMENTS

CN 203769484 U 8/2014
CN 104417460 A 3/2015
(Continued)

OTHER PUBLICATIONS

Chinese Office Action issued in corresponding Chinese Patent Application No. 201710083578.1, dated Nov. 2, 2018, with English Translation.

*Primary Examiner* — Alyson M Merlino
(74) *Attorney, Agent, or Firm* — McDermott Will & Emery LLP

(57) ABSTRACT

A vehicle-door opening and closing device includes: a latch unit configured to keep a vehicle door in a half latched state or a fully latched state; a power close mechanism configured to displace the vehicle door from the half latched state to the fully latched state; a power release mechanism configured to release the fully latched state to bring the vehicle door to an openable state; and a drive gear configured to be driven by a motor. The power release mechanism is configured to be actuated with a drive force of the drive gear. A return switch configured to be switched upon driving in a predetermined drive range sufficient to complete actuation of the power release mechanism is placed near the drive gear. The motor is configured to return the drive gear based on a signal from the return switch.

5 Claims, 15 Drawing Sheets

(51) Int. Cl.
*E05B 79/20* (2014.01)
*E05B 81/06* (2014.01)

(56) References Cited

U.S. PATENT DOCUMENTS

| | | | | |
|---|---|---|---|---|
| 2003/0067175 | A1* | 4/2003 | Shiota | E05B 81/20 292/201 |
| 2005/0016230 | A1* | 1/2005 | Lum | A47F 9/042 70/159 |
| 2014/0000169 | A1* | 1/2014 | Yokomori | E05B 81/06 49/349 |
| 2015/0204113 | A1* | 7/2015 | Machida | E05B 83/40 292/336.3 |
| 2015/0244104 | A1 | 8/2015 | Choo et al. | |
| 2016/0062365 | A1 | 3/2016 | Yamashita | |
| 2017/0130492 | A1* | 5/2017 | Machida | E05B 79/20 |

FOREIGN PATENT DOCUMENTS

| | | | |
|---|---|---|---|
| CN | 104868281 | A | 8/2015 |
| JP | 2014-009477 | A | 1/2014 |
| JP | 2014-1452496 | A | 8/2014 |
| JP | 2016-017347 | A | 2/2016 |
| JP | 2016-017361 | A | 2/2016 |

* cited by examiner

VEHICLE-DOOR OPENING AND CLOSING DEVICE

CROSS-REFERENCE TO RELATED APPLICATION(S)

The present application claims priority to and incorporates by reference the entire contents of Japanese Patent Application No. 2016-053167 filed in Japan on Mar. 16, 2016.

BACKGROUND OF THE INVENTION

1. Field of the Invention

The disclosure relates to a vehicle-door opening and closing device, and more particularly relates to a control device for a power unit of a vehicle-door opening and closing device.

2. Description of the Related Art

A conventionally well-known power unit includes a power close mechanism that turns a latch of a latch unit to displace a vehicle door from a half latched state to a fully latched state, and a power release mechanism that releases the fully latched state to bring the vehicle door to an openable state (for example, see Japanese Patent Application Laid-open No. 2016-017361, Japanese Patent Application Laid-open No. 2014-009477, Japanese Patent Application Laid-open No. 2016-017347, and Japanese Patent Application Laid-open No. 2014-152496).

In control of the power unit, signals from a plurality of switches are used, which are roughly divided into a driven-side switch group for detecting states (positions) of the latch and a ratchet of the latch unit and a driving-side switch group for detecting states (positions) of drive mechanisms that turn the latch and the ratchet with motor power. In addition to the signals from these switches, detection of a load current of the motor is also used in the control. The load current of the motor is an excess current occurring when a drive member driven by the motor abuts on a mechanically immobile member and stops driving.

Detection of the load current of the motor is used as a signal when a drive gear is to be returned to a neutral position after the power unit is actuated. However, because a voltage used in an automobile is low, a detected excess current has a quite high value. Therefore, if a circuit is designed according to the quite-high excess current, a fuse with a quite large capacity and a tough substrate are required, which is quite disadvantageous in the cost.

SUMMARY OF THE INVENTION

It is an object of the present invention to at least partially solve the problems in the conventional technology.

In some embodiments, a vehicle-door opening and closing device includes: a latch unit configured to engage with a striker provided on a vehicle to keep a vehicle door in a half latched state or a fully latched state; a power close mechanism configured to turn a latch of the latch unit to displace the vehicle door from the half latched state to the fully latched state; a power release mechanism configured to release the fully latched state to bring the vehicle door to an openable state; and a drive gear configured to be driven by a motor. The power release mechanism is configured to be actuated with a drive force of the drive gear. A return switch configured to be switched upon driving in a predetermined drive range sufficient to complete actuation of the power release mechanism is placed near the drive gear. The motor is configured to return the drive gear based on a signal from the return switch.

In some embodiments, a vehicle-door opening and closing device includes: a gear-interlocked cam body having a mountain-shaped first cam face and being configured to be moved, by a motor, in a power release direction and a power close direction which is reversely directed to the power release direction; and a neutral switch configured to be switched due to abutment on the first cam face. The vehicle-door opening and closing device detects release from a neutral position with the neutral switch being separated from the first cam face and switched when the gear-interlocked cam body is moved in the power release direction or the power close direction, and determines completion of return to the neutral position to stop the motor when the gear-interlocked cam body is moved in the power release direction or the power close direction and then is reversely rotated and the neutral switch abuts on a left-incline cam face or a right-incline cam face of the mountain-shaped first cam face. A return switch configured to abut on the first cam face to be switched when the gear-interlocked cam body is moved in the power release direction is provided near the neutral switch. The motor is configured to be reversely rotated due to switching of the return switch, to move the gear-interlocked cam body in the power close direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a vehicle-door opening and closing device according to the disclosure are described with reference to the accompanying drawings. In the broad sense, a vehicle-door opening and closing device according to the disclosure represents a device including functions such as a latch function to keep a vehicle door in a closed state, a power function to move the vehicle door with power to be opened or closed, a lock function to prevent unauthorized opening of the vehicle door, and a relay function to operationally couple these functions to each other.

Figure 1:
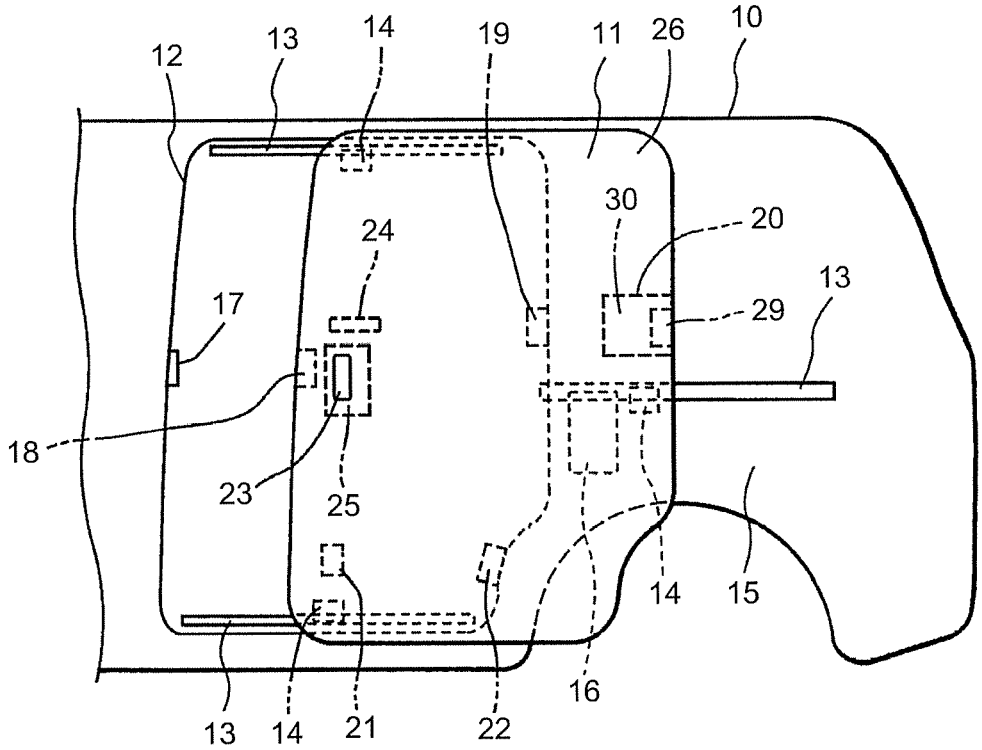
FIG. 1 is a side view illustrating an outline of a vehicle body including a vehicle-door opening and closing device and of a vehicle door according to the disclosure.

FIG. 1 illustrates a side surface of a vehicle including the vehicle-door opening and closing device. The vehicle includes a vehicle body 10, a vehicle door 11, and a door opening 12 of the vehicle body 10. A plurality of guide rails 13 in a front-back direction are fixed to the vehicle body 10, and brackets 14 are provided to the vehicle door 11 to slidably engage with the corresponding guide rails 13, respectively. The vehicle door 11 is attached to the vehicle body 10 to be slidable in the front-back direction.

A power slide device 16 that moves the vehicle door 11 in the front-back direction with motor power to be opened or closed is provided in a space on an interior side of a quarter panel 15 being a rear side surface of the vehicle body 10. A front striker 17 is provided on a front edge portion of the door opening 12 and a front latch device 18 that engages with the front striker 17 is provided on a front end of the vehicle door 11. Similarly, a rear striker 19 is provided on a rear edge portion of the door opening 12 and a rear latch device 20 that engages with the rear striker 19 is provided on a rear end of the vehicle door 11. As is publicly known in the art, the latch devices 18 and 20 each include a latch and a ratchet and engage with the strikers 17 and 19, respectively, to keep the vehicle door 11 in a closed state.

A full open lock 21 including a latch and a ratchet is also provided on the vehicle door 11. When the vehicle door 11 is moved by opening slide to a predetermined fully opened position, the full open lock 21 engages with a full open striker 22 that is fixed to the vehicle body 10 and that has a striker shape to hold the vehicle door 11 at the fully opened position.

An outside open handle 23 is provided on an exterior surface of the vehicle door 11 and an inside open handle 24 is provided on an interior surface of the vehicle door 11. A relay device 25 for a manual operation force or a motor drive force, which is referred to as a "remote control unit" in the field, is placed in an internal space of the vehicle door 11. Manual operation forces of the outside open handle 23 and the inside open handle 24 are transmitted to the front latch device 18, the rear latch device 20, and the full open lock 21 via the relay device 25. When the open handle 23 or 24 is operated in a door closed state, engagement between the front latch device 18 and the front striker 17 and engagement between the rear latch device 20 and the rear striker 19 are released to enable the vehicle door 11 to be opened. When the open handle 23 or 24 is operated in a door opened state, engagement between the full open lock 21 and the full open striker 22 is released to enable the vehicle door 11 to be closed.

Figure 2:
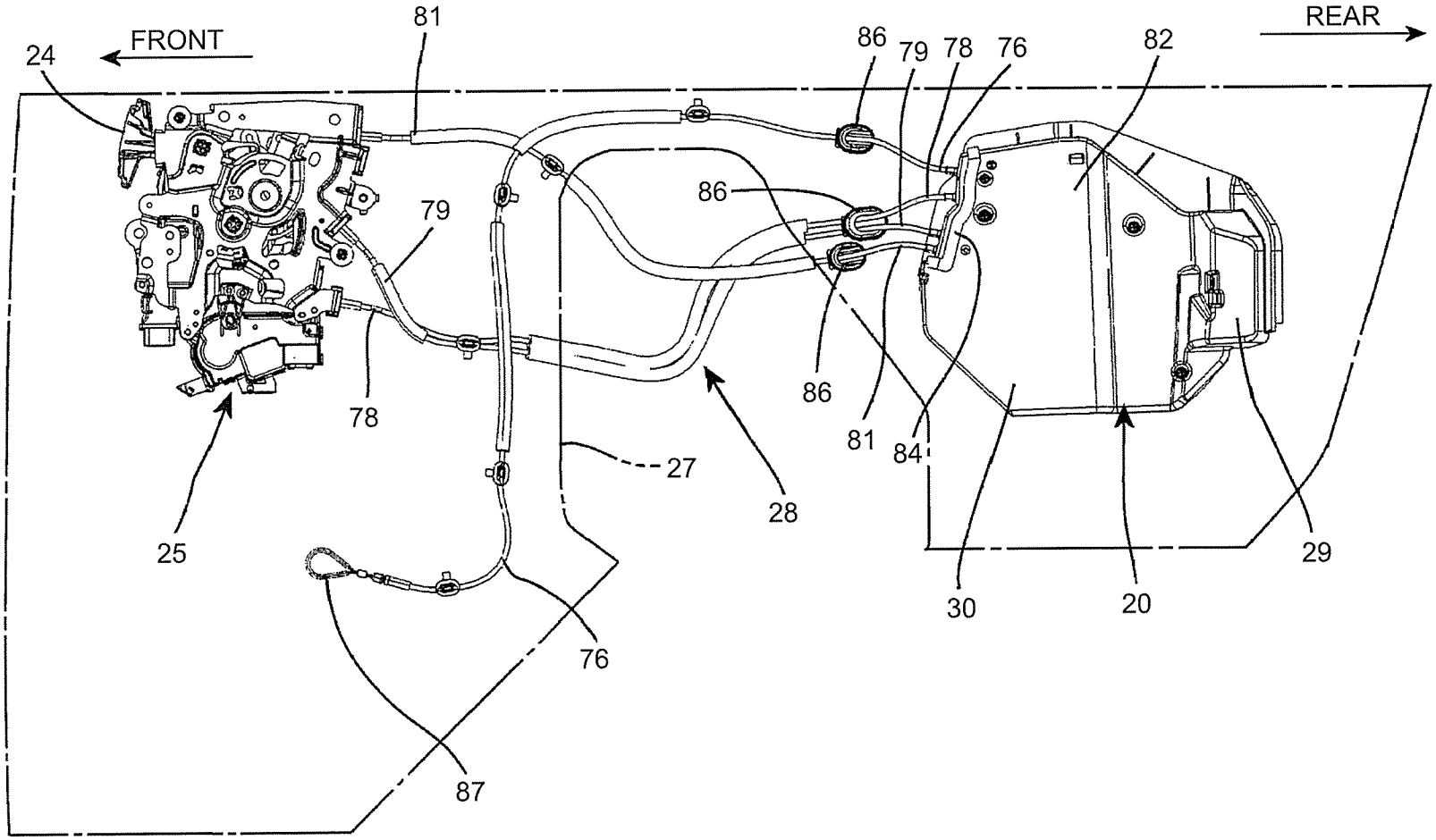
FIG. 2 is a side view illustrating an exterior side of a metallic inner panel of the vehicle door.
Figure 3:
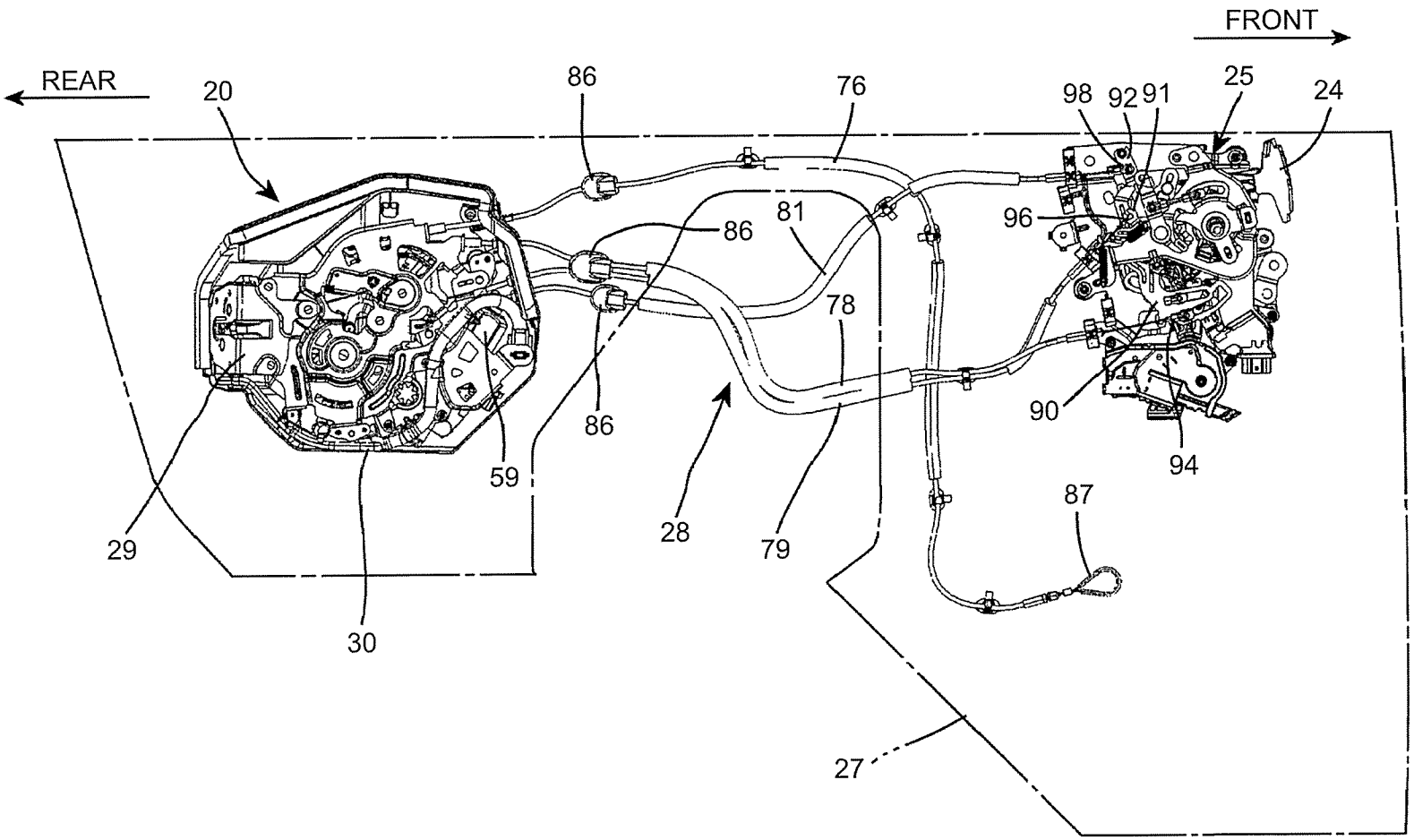
FIG. 3 is a side view illustrating an interior side of the inner panel.

As is publicly known, the vehicle door 11 has a three layer structure including a metallic outer panel 26 facing outside the vehicle, a trim panel (not illustrated) facing inside the vehicle, and a metallic inner panel 27 between the outer panel 26 and the trim panel. FIG. 2 illustrates an exterior side of the inner panel 27 and FIG. 3 illustrates an interior side of the inner panel 27. The rear latch device 20 is placed on an exterior side surface of the inner panel 27 at a rear portion and the relay device 25 is placed on the interior side surface of the inner panel 27 at a front portion. The rear latch device 20 and the relay device 25 are functionally coupled by a transmission unit 28 including a plurality of wire cables.

Figure 4:
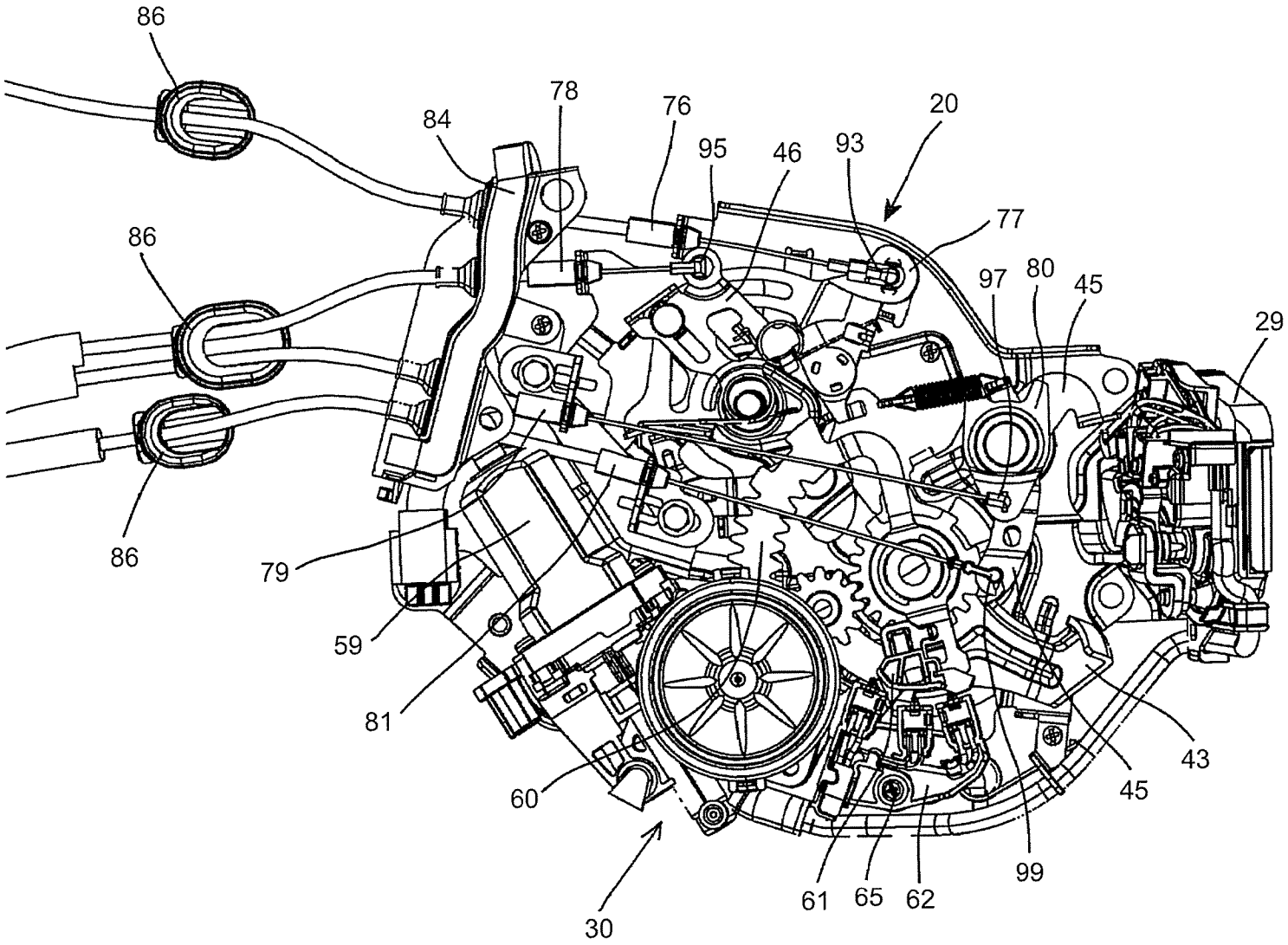
FIG. 4 is a side view illustrating an interior side of a rear latch device of the vehicle-door opening and closing device.

The rear latch device 20 includes a latch unit 29 that meshes with the rear striker 19, and a latch power unit 30 as illustrated in FIG. 4. The latch power unit 30 includes a power close mechanism that displaces the latch unit 29 from a half latched state to a fully latched state with motor power, and a power release mechanism that releases the meshing state between the latch unit 29 and the rear striker 19 with motor power to bring the vehicle door 11 to an openable state. An operation force of the power release mechanism is transmitted also to the latch unit of the front latch device 18 via the relay device 25.

Figure 5:
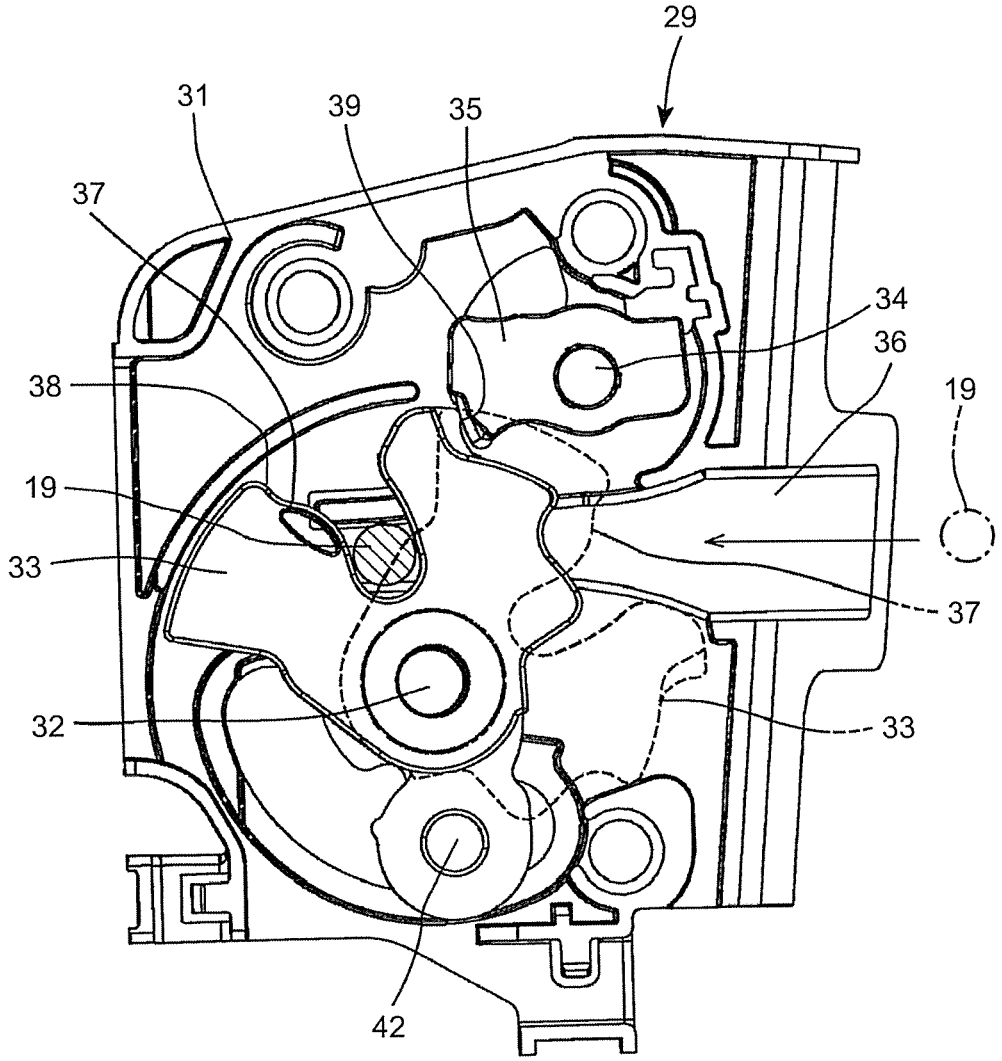
FIG. 5 is a back view of a latch unit of the rear latch device.

As illustrated in FIG. 5, the latch unit 29 has a latch body 31 formed of a synthetic resin or the like. To the latch body 31, a latch 33 is fixed with a latch shaft 32 and a ratchet 35 is fixed with a ratchet shaft 34. When the vehicle door 11 is moved to be closed, the rear striker 19 fixed to the vehicle body 10 relatively enters an entrance path 36 of the latch body 31 to engage with an engagement groove 37 of the latch 33 and turns the latch 33 at an unlatched position indicated by a broken line in a full latch direction (a counterclockwise direction). The ratchet 35 is being biased with a spring elastic force in the counterclockwise direction. Accordingly, when the latch 33 takes a half latched position, the ratchet 35 is turned in the counterclockwise direction to engage with a half-latch engagement part 38 of the latch 33. When the latch 33 is further turned to a fully latched position, the ratchet 35 engages with a full-latch engagement part 39 of the latch 33 and the vehicle door 11 is kept in the closed state.

Figure 6:
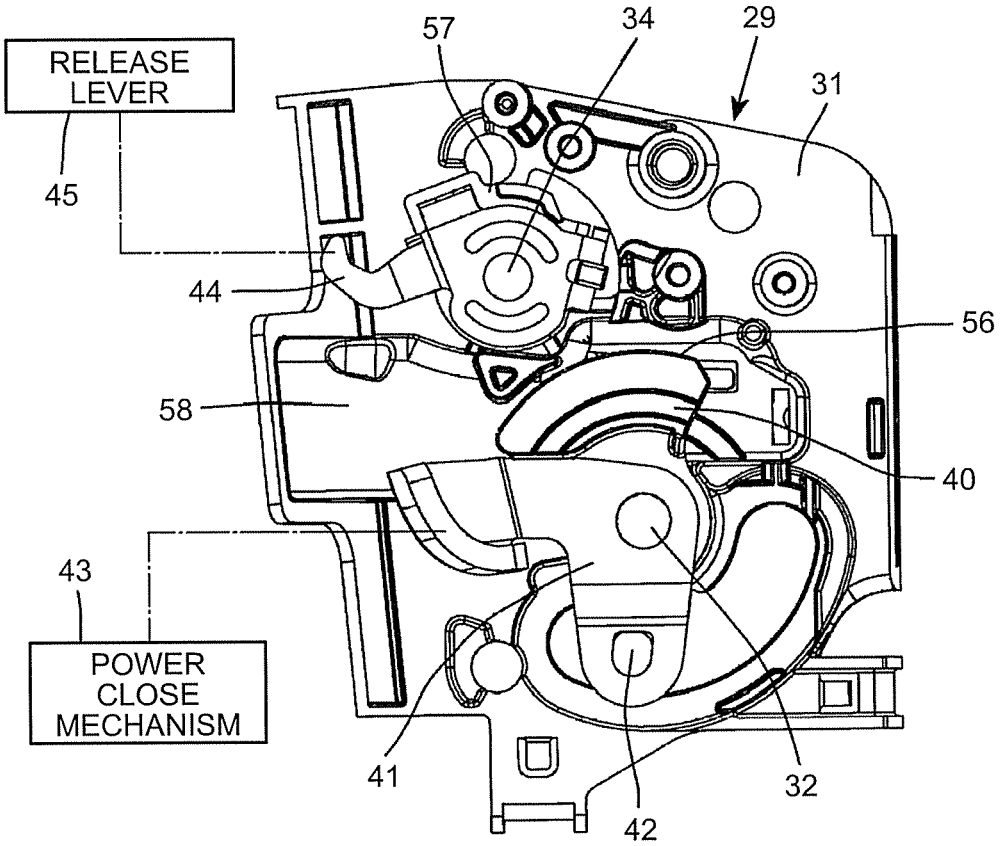
FIG. 6 is a front view of the latch unit of the rear latch device.

FIG. 6 illustrates a back side of the latch body 31 (a front side with reference to the vehicle). A latch switch lever 40 and a power close lever 41 are attached to an end of the latch shaft 32. The latch switch lever 40 and the power close lever 41 are configured to turn together with the latch 33 in an interlocked manner. In the present embodiment, the latch switch lever 40 and the power close lever 41 are coupled to each other with a coupling pin 42 passing through the latch body 31 and turn around the latch shaft 32 in an interlocked manner.

A power close mechanism 43 (see FIG. 4) of the latch power unit 30 is relatedly coupled to the power close lever 41. When the power close lever 41 is turned with a turning force of the power close mechanism 43, the latch 33 at the half latched position is turned to the fully latched position (closing a door toward the fully latched state is sometimes referred to as "CINCH"). FIG. 6 illustrates the fully latched state in which the power close lever 41 is at the fully latched position.

A ratchet lever 44 that turns with the ratchet 35 in an interlocked manner is provided at an end of the ratchet shaft 34. The ratchet lever 44 is preferably made of a metallic plate, which is partially bent to be engaged with the ratchet 35 to enable the ratchet lever 44 to be interlocked therewith.

A release lever 45 of the latch power unit 30 is operationally connected to the ratchet lever 44. Turn of the release lever 45 releasably turns the ratchet lever 44 to release the ratchet 35 from the latch 33 to bring the vehicle door 11 to an openable state. The release lever 45 is actuated and turned with power of a power release mechanism 46 of the latch power unit 30 or an opening operation force of the open handle 23 or 24, which will be described later.

Figure 7:
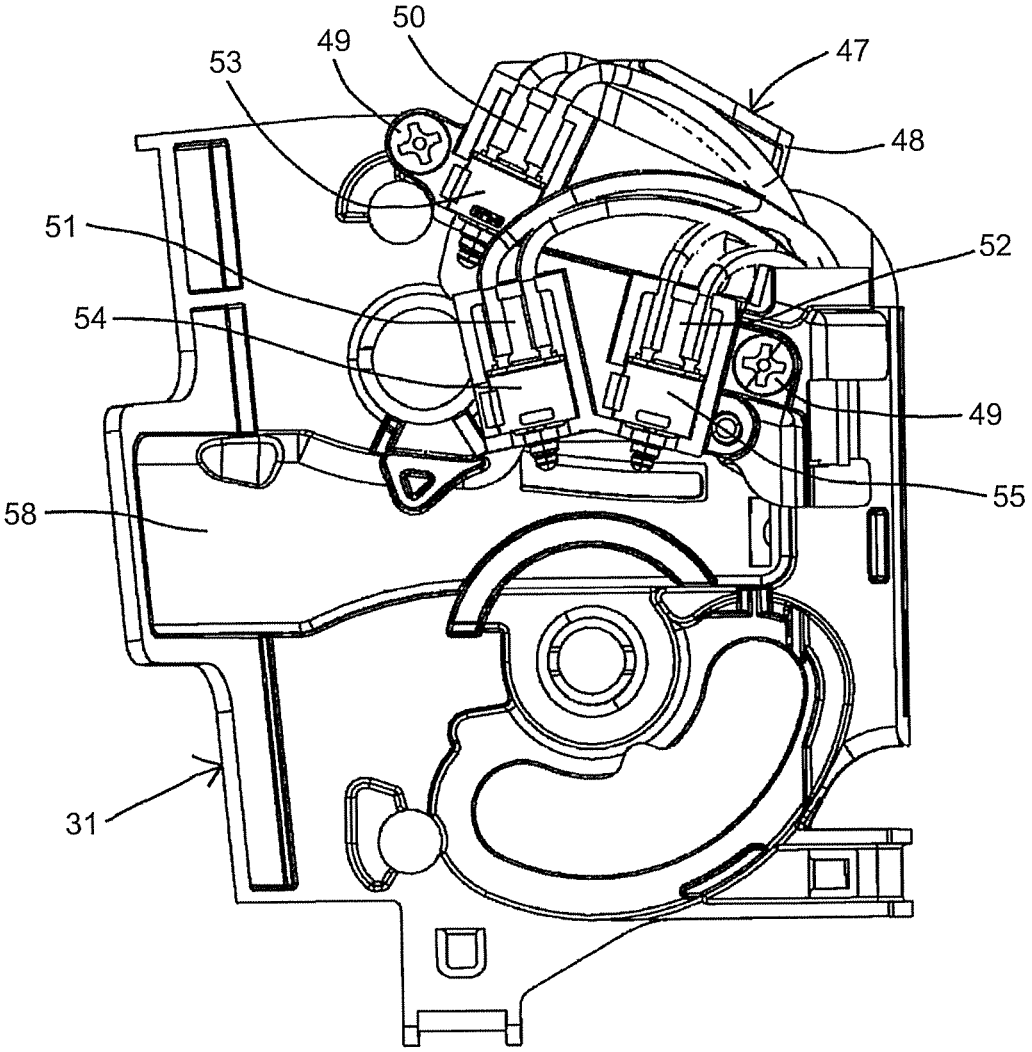
FIG. 7 is a front view of a state in which a switch assembly is attached to a latch body of the latch unit.
Figure 8:
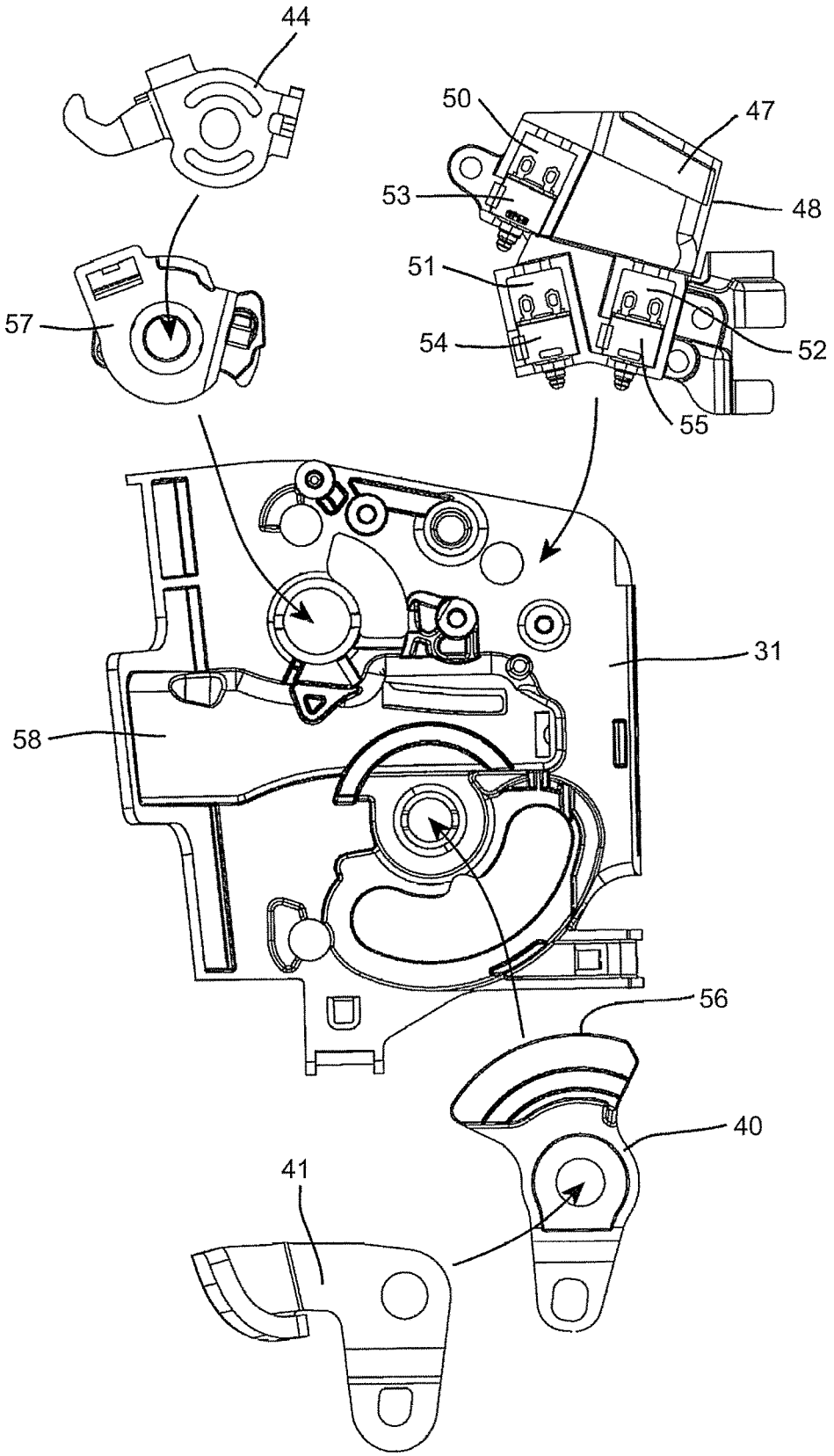
FIG. 8 is an exploded view of a latch body as viewed from the front side of the latch unit.

A latch-unit switch assembly 47 is provided on an upper part of the front side of the latch body 31 as illustrated in FIGS. 7 and 8. A switch case 48 thereof made of a synthetic resin is fixed to the latch body 31 with a fastening unit 49 such as screws. Three switch housing units 50, 51, and 52 are formed integrally with the switch case 48. A ratchet switch 53, a half latch switch 54, and a full latch switch 55 are housed in advance in the switch housing unit 50, the switch housing unit 51, and the switch housing unit 52 and are manufactured as separate assemblies, respectively. The switch case 48 in a state attached with the switches 53 to 55 is fixed to the latch body 31 with the fastening unit 49.

The half latch switch 54 and the full latch switch 55 abut in turns on a latch cam face 56 of the latch switch lever 40 that turns with the latch 33 in an interlocked manner. When the latch 33 enters the half latched state, the half latch switch 54 is turned ON. When the latch 33 enters the fully latched state, the full latch switch 55 as well as the half latch switch 54 is turned ON. The half latch switch 54 and the full latch switch 55 only relatively detect a turning position of the latch 33 and thus do not indicate whether the ratchet 35 is actually engaged with the half-latch engagement part 38 or the full-latch engagement part 39 of the latch 33.

The ratchet switch 53 is turned ON or OFF due to abutment on a ratchet cam lever 57 in FIG. 6 turning together with the ratchet lever 44. A "normally closed" switch is used as the ratchet switch 53 in the present embodiment. When the ratchet 35 is engaged with the latch 33, the switch is pressed to be turned OFF and stops an output as illustrated in an operation chart. The switch case 48 is placed substantially above a back-side bulging portion 58 of the latch body 31, which defines the entrance path 36.

The latch power unit 30 having the power close mechanism 43 and the power release mechanism 46 is driven by a common motor 59 (FIG. 4). Normal rotation and reverse rotation of the motor 59 cause a ring-shaped drive gear 60 to perform counterclockwise rotation (power close rotation, cinch rotation) and clockwise rotation (power release rotation) from a neutral position, respectively. For a configuration of the latch power unit itself, a conventional configuration described in Japanese Patent Application Laid-open No. 2016-17361 or 2014-9477 can be used, and descriptions of details about the configuration are omitted. In FIG. 4, when the drive gear 60 is rotated in the counterclockwise direction from the neutral position with power of the motor 59, the power close lever 41 in FIG. 6 is turned in the full latch direction via the power close mechanism 43. When the latch 33 reaches the fully latched position, the ratchet 35 engages with the full-latch engagement part 39 of the latch 33, resulting in a door closed state. When the drive gear 60 performs the clockwise rotation (power release rotation) from the neutral position, the power release mechanism 46 is actuated and power is transmitted to the relay device 25 via the transmission unit 28 including the wire cables. The power is returned to the release lever 45 from the relay device 25 via the transmission unit 28 again to turn the ratchet lever 44 in FIG. 6 and disengage the ratchet 35 from the latch 33, resulting in a door openable state. A reason why the power is transmitted via the relay device 25 is that the power of the power release mechanism 46 is to be transmitted also to the front latch device 18.

After performing the power close rotation or the power release rotation, the drive gear 60 is reversely rotated to be returned to the neutral position. As described later, the neutral position of the drive gear 60 includes two types, that is, a door-closed-time neutral position to which the drive gear 60 is mainly returned after having been brought to the door closed state due to the power close rotation, and a door-open-time neutral position to which the drive gear 60 is returned after having been brought to the door open state due to the power release rotation. To be precise, the neutral position of the drive gear 60 after door closing or door opening without power is performed does not always completely match the "door-closed-time neutral position" or the "door-open-time neutral position". However, because the present application relates to opening and closing control using power, these two types of neutral positions are mainly described.

Figure 9:
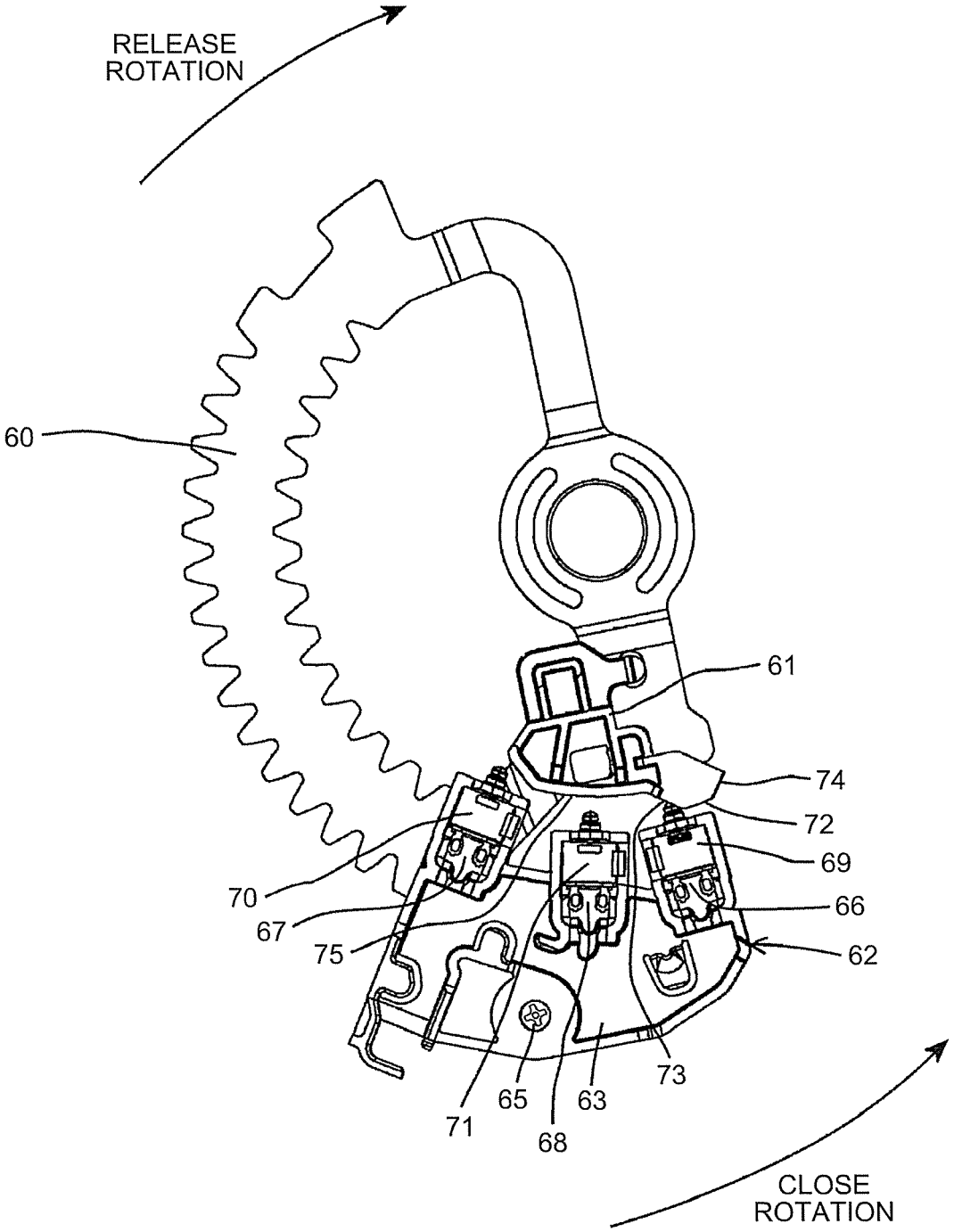
FIG. 9 is an enlarged side view of a ring-shaped drive gear of a latch power unit of the rear latch device, a gear-interlocked cam body, and a switch assembly in a door-closed-time neutral state.

A gear-interlocked cam body 61 is attached to the drive gear 60. A power-unit switch assembly 62 is provided near the gear-interlocked cam body 61 as illustrated in FIG. 9. A switch case 63 of the switch assembly 62, which is made of a synthetic resin, is fixed to a base plate 64 of the latch power unit 30 with a fastening unit 65 such as a screw. Three switch housing units 66, 67, and 68 are formed integrally with the switch case 63. A neutral switch 69 is housed in the switch housing unit 66, a gear detection switch 70 is housed in the switch housing unit 67, and a return switch 71 is housed in the middle switch housing unit 68. The switch case 63 and the switches 69 to 71 are manufactured as separate assemblies.

The neutral switch 69 is turned ON or OFF due to abutment on a mountain-shaped first cam face 72 formed at an end of the gear-interlocked cam body 61. As the neutral switch 69 of the present embodiment, a "normally closed" switch is used, which is turned OFF when pressed by the first cam face 72 and stops an output as illustrated in an operation chart.

As illustrated in FIG. 9, a state in which a left-incline cam face 73 of the first cam face 72 is in contact with the neutral switch 69 and the neutral switch 69 is OFF is the door-closed-time neutral position of the drive gear 60. When power release actuation is started from the state illustrated in FIG. 9, the drive gear 60 rotates in the clockwise direction and the neutral switch 69 moves over the first cam face 72 and is separated from a right-incline cam face 74 to be switched from OFF to ON.

The gear detection switch 70 is configured to be turned ON due to abutment on a second cam face 75 formed as a single arc-like face in the gear-interlocked cam body 61.

Figure 10:
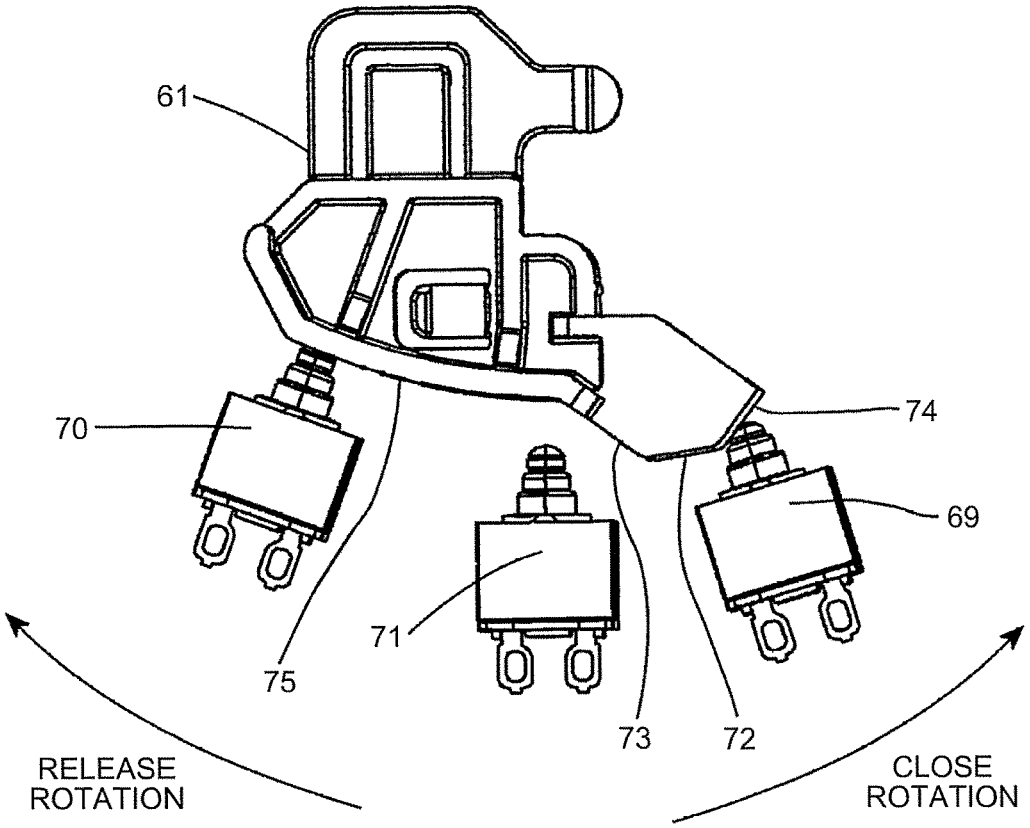
FIG. 10 is an enlarged side view of the gear-interlocked cam body and the switch assembly in a door-open-time neutral state.

FIG. 10 illustrates a relation of the gear-interlocked cam body 61 and the switches 69 to 71 in a door-open-time neutral state. In the door-open-time neutral state, the neutral switch 69 is in contact with the right-incline cam face 74 of the first cam face 72 and is OFF, and the gear detection switch 70 is in contact with a left end portion of the second cam face 75 and is ON.

Door Closing Actuation by Power Close Mechanism

Figure 11:
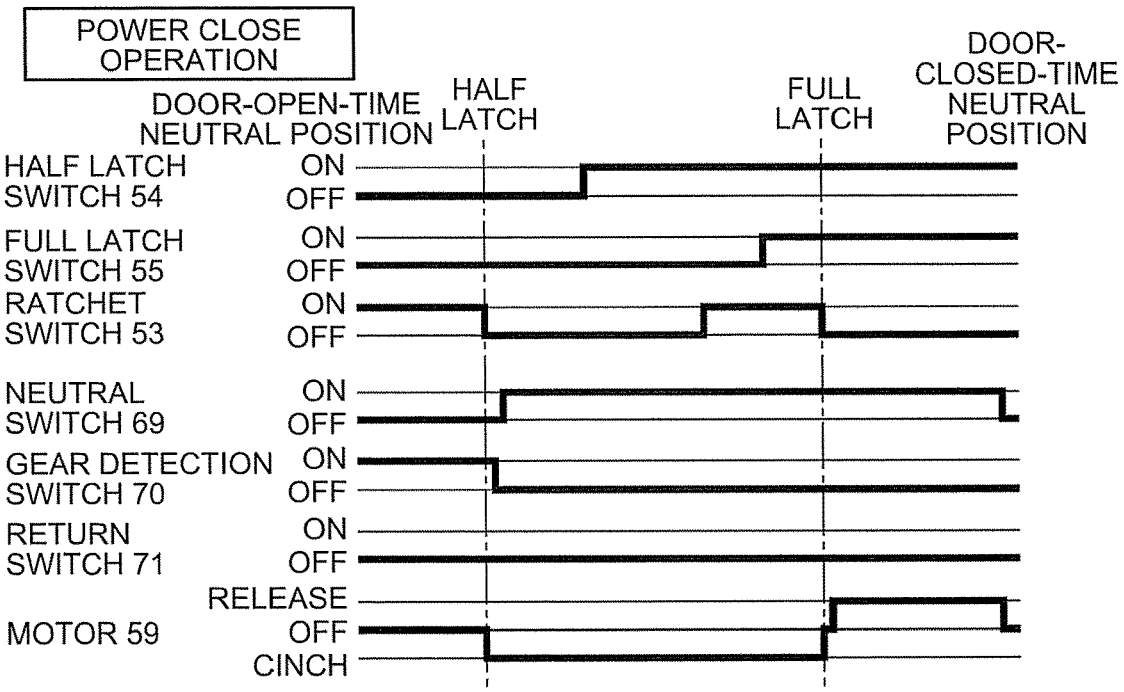
FIG. 11 is an operation chart of power closing actuation.

Door closing actuation by the power close mechanism 43 is described with reference to a chart of FIG. 11. When the vehicle door 11 is moved in the closing direction by the power slide device 16 or manually, the rear striker 19 abuts on the latch 33 to turn the latch 33 in the full latch direction and the half-latch engagement part 38 of the latch 33 passes a click of the ratchet 35, the ratchet 35 turns and the "normally closed" ratchet switch 53 is pressed to be switched from ON to OFF. Accordingly, the half latched state is detected in the system, the motor 59 is activated, the power close mechanism 43 performs the power close rotation, and the drive gear 60 rotates in the counterclockwise direction from the door-open-time neutral position illustrated in FIG. 10. The power slide device 16 then relays the door closing actuation (cinch actuation) to the power close mechanism 43 to end the actuation and returns to the initial state.

When the gear-interlocked cam body 61 is moved further by the power close mechanism 43 in the power close direction in FIG. 10, the gear detection switch 70 is released from the second cam face 75 to be turned OFF. Subsequently, the "normally closed" neutral switch 69 moves over the first cam face 72 and is separated from the left-incline cam face 73 to be switched from OFF to ON. When the drive gear 60 continues the counterclockwise rotation, the power close lever 41 in FIG. 6 is turned in the full latch direction via the power close mechanism 43 and the latch 33 is also turned in the full latch direction.

When the turn of the latch 33 in the full latch direction is continued, the latch cam face 56 of the latch switch lever 40 comes in contact with the half latch switch 54 to turn the half latch switch 54 ON, and subsequently the full latch switch 55 abuts on the latch cam face 56 to be turned ON. In this process, the ratchet switch 53 is temporarily pushed back in the door opening direction to be switched from OFF to ON due to abutment on a side surface of the latch 33. When the full-latch engagement part 39 of the latch 33 passes the click of the ratchet 35 due to the turn of the latch 33 in the full latch direction, the ratchet 35 is turned again and the ratchet switch 53 is switched from ON to OFF, so that the fully latched state is detected in the system.

When the fully latched state is detected based on a switching signal from the ratchet switch 53, the motor 59 is reversely rotated and the drive gear 60 is rotated in the release direction to return to neutral. The return to neutral is detected by the "normally closed" neutral switch 69 abutting on the left-incline cam face 73 of the first cam face 72 to be switched from ON to OFF. The drive gear 60 stops at the door-closed-time neutral position illustrated in FIG. 9 and the power close actuation ends. In this way, closing of the vehicle door 11 is completed.

In the power close actuation described above, rotation control on the motor 59 is all executed based on detection signals (ON and OFF signals) from the various switches. Accordingly, members such as the drive gear 60 and the power close mechanism 43 that rotate, move, or displace with power of the motor 59 do not abut on abutment stoppers (immobile members) that define a mechanical movable range during normal control. Therefore, a situation in which an excessive load current that may occur at the time of mechanical abutment flows through a control circuit for the motor 59 and damages the control circuit can be avoided and also the cost of the control circuit can be reduced.

Door Opening Actuation by Power Release Mechanism

Figure 12:
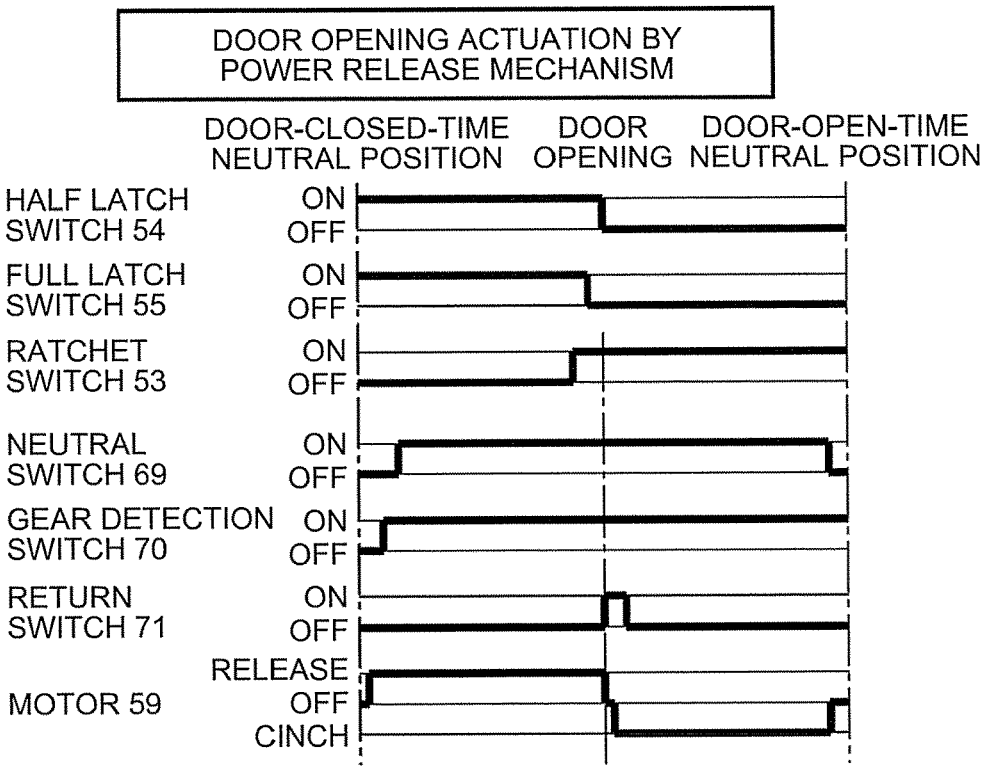
FIG. 12 is an operation chart of power release actuation when the vehicle door is closed.

In the door closed state in which the ratchet 35 engages with the full-latch engagement part 39 of the latch 33, the drive gear 60 is at the door-closed-time neutral position illustrated in FIG. 9. When the outside open handle 23 or the inside open handle 24 is operated or a remote control for door opening and closing is operated in this state, the motor 59 performs the release rotation, the drive gear 60 rotates in the clockwise direction in FIG. 9, and the "normally closed" neutral switch 69 moves over the first cam face 72 and is separated from the right-incline cam face 74 to be turned ON as illustrated in a chart of FIG. 12. Before the neutral switch 69 is turned ON, the gear detection switch 70 abuts on the second cam face 75 and is switched to ON, and continuation of the power release actuation is detected.

When the drive gear 60 continues the clockwise rotation, the power release mechanism 46 is actuated, power is transmitted to the relay device 25 via the transmission unit 28 including the wire cables, and the power is returned to the release lever 45 from the relay device 25 via the transmission unit 28 again to turn the ratchet lever 44 in FIG. 6. The ratchet 35 is disengaged from the latch 33 to bring the vehicle door 11 to an openable state and also the "normally closed" ratchet switch 53 is released to be switched from OFF to ON.

When the drive gear 60 further performs the release rotation, the return switch 71 abuts on the left-incline cam face 73 of the first cam face 72 to be turned ON. Based thereon, the motor 59 reversely rotates to cause the drive gear 60 to perform close rotation toward the neutral position. When the "normally closed" neutral switch 69 abuts on the right-incline cam face 74 of the first cam face 72 to be switched from ON to OFF, the motor 59 stops, the drive gear 60 is returned to the door-open-time neutral position in FIG. 10, and the door opening actuation by the power release mechanism ends. Normally, when the power release mechanism brings the vehicle door 11 to the openable state, that is, when the ratchet switch 53 is turned ON, the full latch switch 55 is turned OFF, and the half latch switch 54 is turned OFF, power slide toward the door opening direction is started by the power slide device 16, and the vehicle door 11 is moved to the open position and is kept at the open position by the full open lock 21.

Also in the door opening actuation by the power release mechanism, rotation control on the motor 59 is all executed based on detection signals (ON and OFF signals) from the various switches. Therefore, drive members do not abut on the abutment stoppers that define a mechanical movable range and therefore occurrence of an excessive load current that may damage a circuit can be avoided.

Full-Open-Lock Releasing Actuation by Power Release Mechanism

Figure 13:
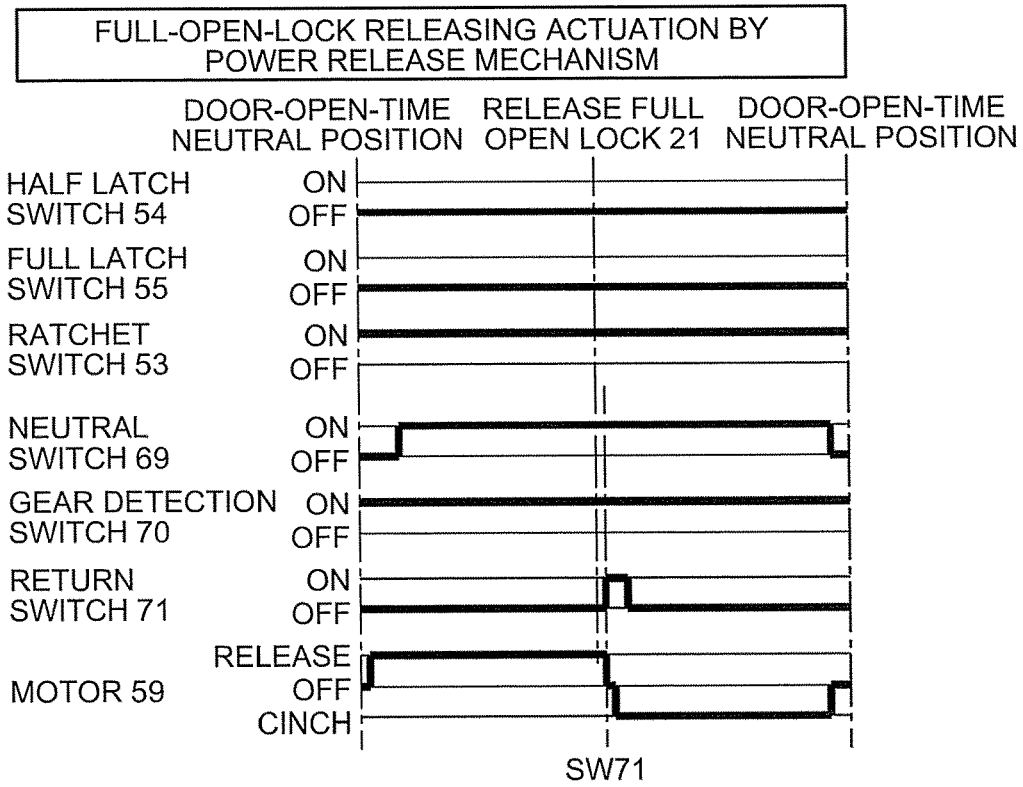
FIG. 13 is an operation chart of power release actuation for releasing a full open lock when the vehicle door is opened.

When the outside open handle 23 or the inside open handle 24 is operated or the remote control for door opening and closing is operated in a state where the vehicle door 11 has been moved to the open position and the full open striker 22 has engaged with the full open lock 21 to keep the vehicle door 11 at the open position, the motor 59 performs the release rotation, the drive gear 60 located at the door-open-time neutral position in FIG. 10 rotates in the clockwise direction, the "normally closed" neutral switch 69 moves over the first cam face 72 and is separated from the right-incline cam face 74 to be turned ON as illustrated in a chart of FIG. 13. The gear detection switch 70 that monitors the open state of the vehicle door 11 continuously abuts on the second cam face 75 and is kept ON.

When the drive gear 60 continues the clockwise rotation, the power release mechanism 46 is actuated, and power is transmitted to the relay device 25 via the transmission unit 28 including the wire cables to move a ratchet of the full open lock 21 via the relay device 25 to be disengaged from the latch, so that the full open lock 21 and the full open striker 22 are disengaged from each other. Accordingly, the vehicle door 11 is brought to the closable state.

When the drive gear 60 further performs the release rotation, the return switch 71 abuts on the left-incline cam face 73 of the first cam face 72 to be turned ON. Based thereon, the motor 59 reversely rotates and causes the drive gear 60 to perform the close rotation toward the neutral position. When the "normally closed" neutral switch 69 abuts on the right-incline cam face 74 of the first cam face 72 to be switched from ON to OFF, the motor 59 stops, the drive gear 60 is returned to the door-open-time neutral position in FIG. 10, and the full-open-lock releasing actuation by the power release mechanism ends. Normally, at a time when the return switch 71 abuts on the left-incline cam face 73 and is turned ON, it is determined that releasing of the full open lock 21 by the power release mechanism is completed, and the door closing with power by the power slide device 16 is started. When the vehicle door 11 is closed to a predetermined position, the door closing actuation by the power close mechanism is started in the manner as described above.

Also in the power releasing actuation at the time of door opening, rotation control on the motor 59 is all executed based on detection signals (ON and OFF signals) from the various switches. Therefore, the drive members do not abut on the abutment stoppers that define the mechanical movable range and therefore occurrence of an excessive load current that may damage the circuit can be avoided.

Referring back to FIGS. 2 and 3, the transmission unit 28 has four wire cables and one side of the four wire cables is operationally coupled to the latch power unit 30 placed on the exterior side of the inner panel 27. A first wire cable 76 is coupled to a ratchet-power-path open lever 77 of the latch power unit 30. The ratchet-power-path open lever 77 blocks or opens a power transmission path between the power release mechanism 46 and the release lever 45. When the power transmission path is opened, the release lever 45 becomes capable of turning with the spring elastic force. Accordingly, even if an actuation failure (drive system immobilization) occurs in the power release mechanism 46 due to a malfunction of the motor 59 or the like, the release lever 45 enables the ratchet 35 to be engaged with the latch 33 without being affected by the failure. Accordingly, a door-closing disabled state based on the actuation failure of the drive system can be overcome.

A second wire cable 78 is coupled to the power release mechanism 46 to transmit rotation of the power release mechanism 46 to the relay device 25. A third wire capable 79 is coupled to a power-close stop lever 80. When an operation force of the outside open handle 23 or the inside open handle 24 is transmitted to the power-close stop lever 80 via the relay device 25, the power-close stop lever 80 cancels the actuation of the power close mechanism 43. A fourth wire cable 81 is coupled to the release lever 45. The wire cable 81 transmits the operation force of the outside open handle 23 or the inside open handle 24 or the drive force transmitted from the power release mechanism 46 to the relay device 25 via the wire cable 78 to the release lever 45 and enables the vehicle door 11 to be opened.

Figure 14:
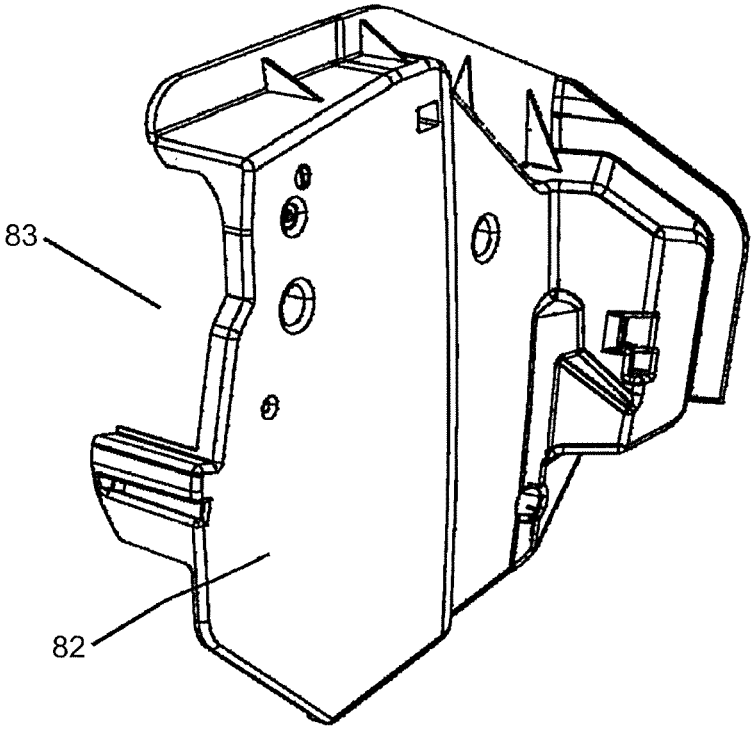
FIG. 14 is a perspective view of a waterproof cover of the rear latch device.
Figure 15:
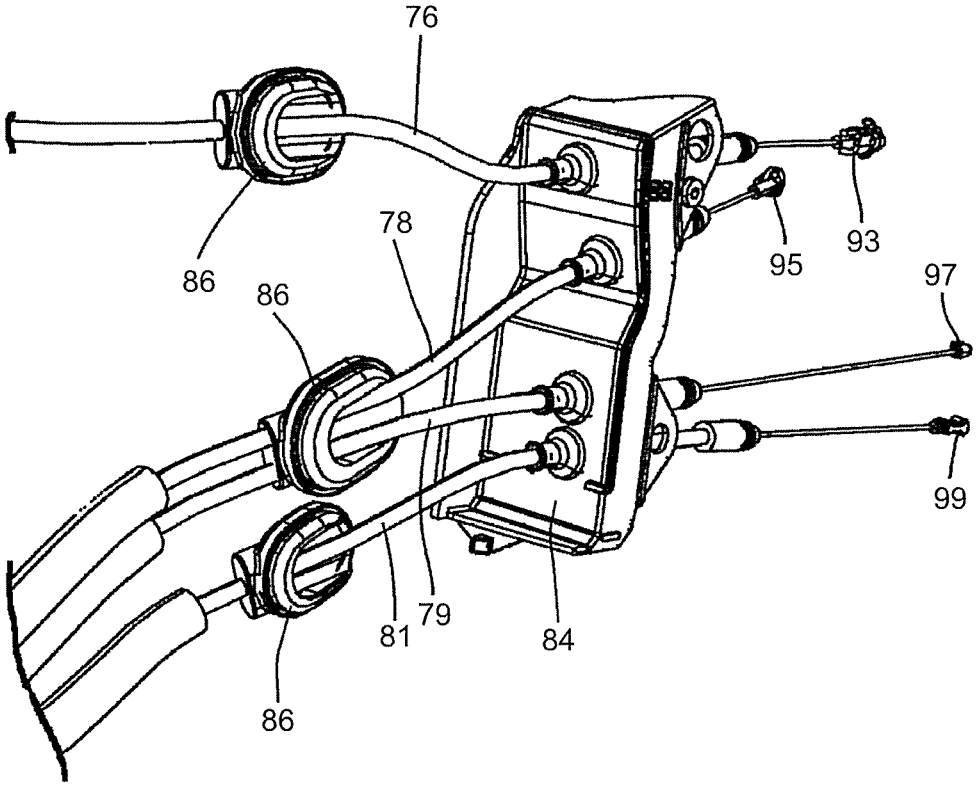
FIG. 15 is a perspective view of one side of a transmission unit of the vehicle-door opening and closing device.

FIG. 14 illustrates a waterproof cover 82 to be attached to the rear latch device 20, which enhances the waterproof property of the rear latch device 20 provided on the exterior side of the inner panel 27 into which rainwater is likely to penetrate. An attachment opening 83 is formed in the waterproof cover 82 at the front edge with reference to the vehicle.

Figure 16:
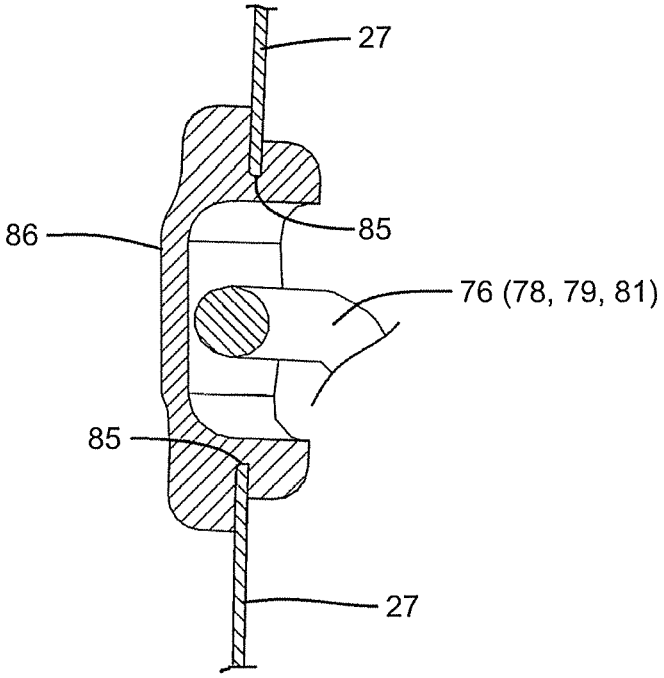
FIG. 16 is an enlarged cross-sectional view of a waterproof circular grommet of the transmission unit and the inner panel.

The transmission unit 28 includes a side cover 84 that covers the attachment opening 83. The four wire cables 76, 78, 79, and 81 pass through the side cover 84. The other side of the four wire cables 76, 78, 79, and 81 is routed to the interior side of the inner panel 27 through cable holes 85 thereof (FIG. 16). A waterproof circular grommet 86 made of rubber is fitted to each of the cable holes 85. The waterproof circular grommets 86 are attached to the wire cables 76, 78, 79, and 81, respectively, in advance. The side cover 84, the wire cables 76, 78, 79, and 81, and the waterproof circular grommets 86 are assembled as an assembly. A large opening (a service hole) at the center of the inner panel 27 and other small openings are sealed with cover members in a waterproof manner, respectively.

While the transmission unit 28 passes through the cable holes 85 of the inner panel 27 and extends from the exterior side to the interior side as described above, penetration of rainwater flowing along the wire cables 76, 78, 79, and 81 of the transmission unit 28 into the interior side of the inner panel 27 can be satisfactorily prevented because the waterproof circular grommets 86 are provided to the wire cables 76, 78, 79, and 81. Furthermore, the waterproof circular grommets 86 can be used as a temporary joint when the transmission unit 28 manufactured as an assembly is attached to the vehicle door 11.

The other side of the wire cables 76, 78, 79, and 81 is routed to the interior side of the inner panel 27. The other side of the wire cable 76 is fastened to the interior side surface of the inner panel 27 as a manual emergency-operation unit 87 and is normally hidden by a trim panel. The manual emergency-operation unit 87 is formed in a circular shape or an annular shape so as to be easily manually pulled. A protection tube 88 is attached to a circular portion for protection of the portion when being pulled. An end of a turned-back wire is fixed to the wire body with a fixture 89 that is subjected to crushing processing. The one side of the wire cable 76 is coupled to the ratchet-power-path open lever 77 as described above. When the drive system is immobilized due to a malfunction of the motor 59 of the power release mechanism 46 or the like, the manual emergency-operation unit 87 is pulled to turn the ratchet-power-path open lever 77 and to release the release lever 45 from the drive system such as the motor 59. Accordingly, the ratchet 35 is enabled to be engaged with the latch 33 without being affected by an actuation failure of the drive system, and a closing disabled state can be prevented even when the drive system such as the motor 59 is immobilized.

Figure 17:
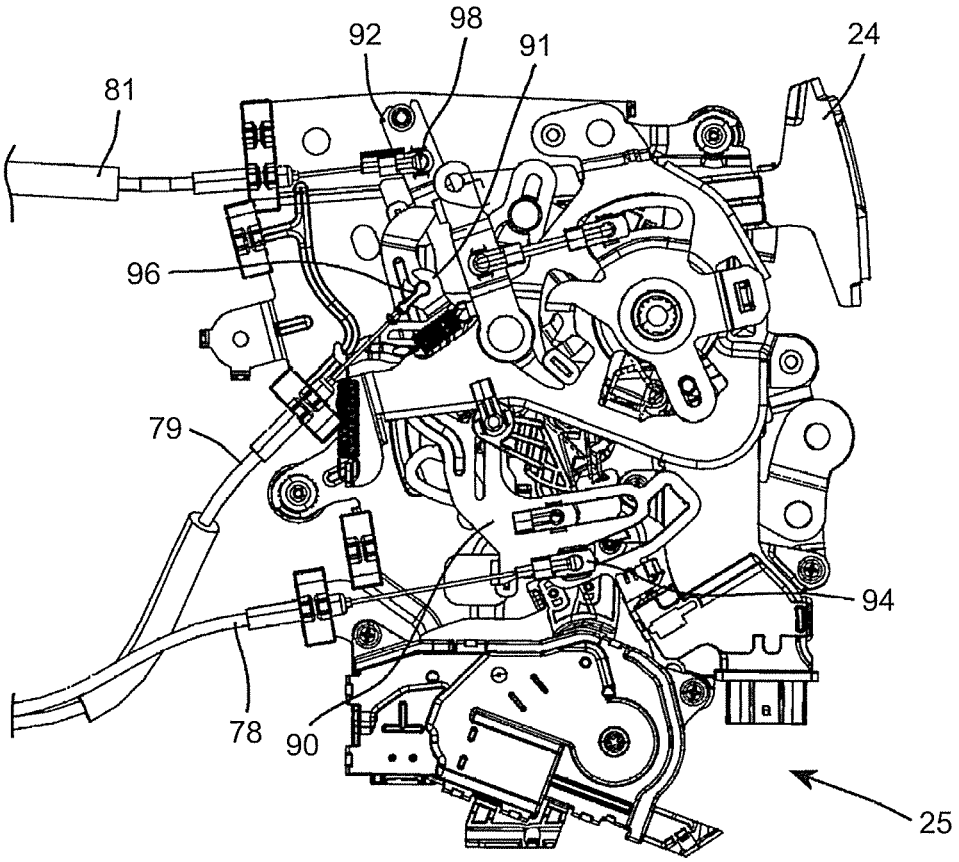
FIG. 17 is a side view illustrating an interior side of a relay device of the vehicle-door opening and closing device.

The other side of the remaining three wire cables 78, 79, and 81 is coupled to the relay device 25. A conventional configuration described in Japanese Patent Application Laid-open No. 2016-17347 can be used for a configuration of the relay device itself and thus descriptions of details about the configuration are omitted. As illustrated in FIG. 17, the other side of the wire cable 78 is coupled to an outer open lever 90 of the relay device 25 so as to transmit power of the power release mechanism 46 to the outer open lever 90 via the wire cable 78. The outside open handle 23 is coupled to the outer open lever 90.

The other side of the wire cable 79 is coupled to a close cancel lever 91. The close cancel lever 91 is turned by an operation of the outside open handle 23 or the inside open handle 24 and turns the power-close stop lever 80 via the wire cable 79 to cancel the actuation of the power close mechanism 43.

The other side of the wire cable 81 is coupled to a disengaging lever 92. The disengaging lever 92 is turned with turn of the outer open lever 90 or an operation of the inside open handle 24 and actuates the release lever 45 to disengage the ratchet 35 from the latch 33, resulting in the door openable state.

The transmission unit 28 includes the four wire cables 76, 78, 79, and 81, and includes eight cable ends. While the eight cable ends are preferably all formed in different shapes, it is desirable that at least cable ends of the one side of the wire cables 76, 78, 79, and 81 extending toward the exterior side of the inner panel 27 have different shapes. Coupling portions of turning ends of the lever members to be coupled to the cable ends also have different particular shapes. Therefore, coupling portions between the cable ends and the lever members have exclusive shapes to be exclusively coupled to each other, which prevents a coupling error. Similarly, cable ends of the wire cables 76, 78, 79, and 81 on the other side extending toward the interior side of the inner panel 27 have different shapes and are coupled to lever members having different coupling portions, respectively, which similarly prevents a coupling error. The other end of the wire cable 76 is formed as the manual emergency-operation unit 87 in the circular shape and thus naturally has a particular shape.

Figure 18:
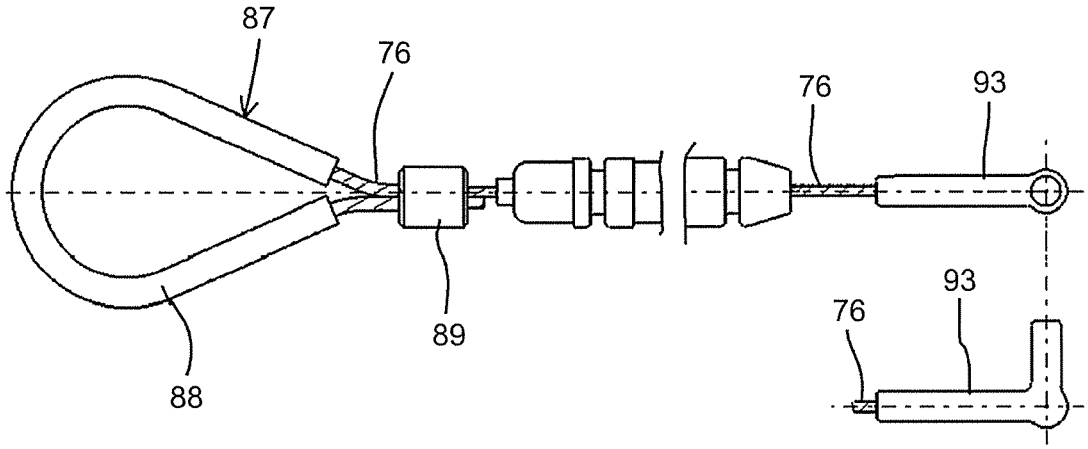
FIG. 18 is a partially cutout explanatory diagram illustrating a cable end of a power-release cancellation wire cable of the transmission unit.
Figure 19:
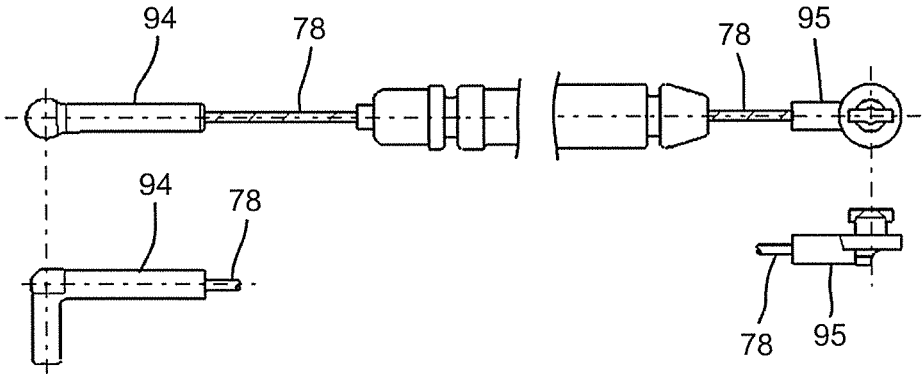
FIG. 19 is a partially cutout explanatory diagram illustrating a cable end of a power-release mechanism wire cable of the transmission unit.
Figure 20:
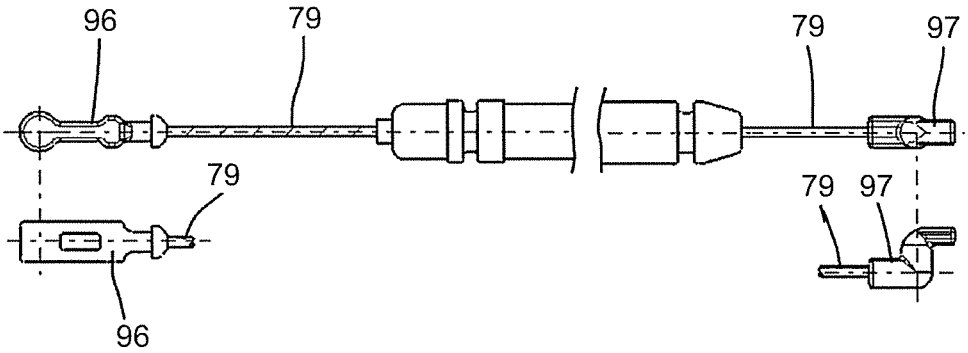
FIG. 20 is a partially cutout explanatory diagram illustrating a cable end of a power-close cancellation wire cable of the transmission unit.
Figure 21:
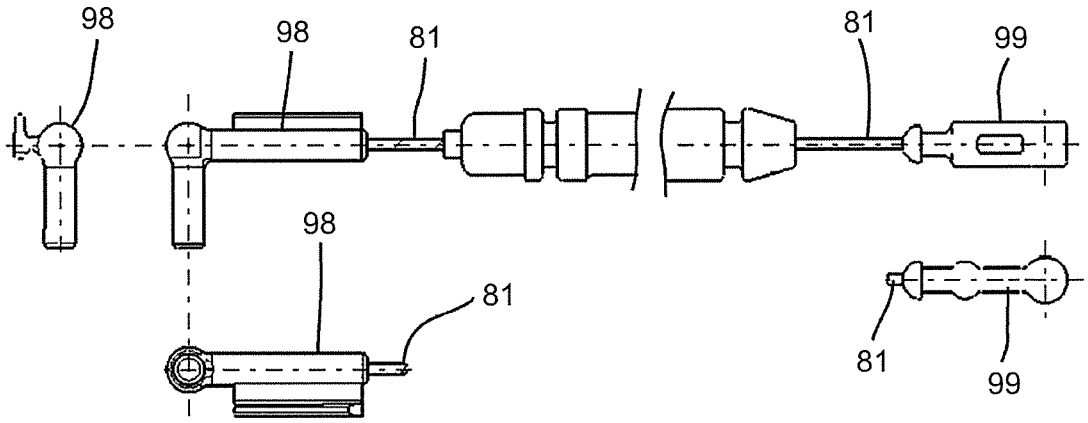
FIG. 21 is a partially cutout explanatory diagram illustrating a cable end of a ratchet-release wire cable of the transmission unit.

Specific shapes of the seven cable ends are illustrated sequentially in FIG. 18 and the following drawings. A cable end 93 of the wire cable 76 on the one side is illustrated in a right part of FIG. 18. A cable end 94 of the wire cable 78 on the other side is illustrated in a left part of FIG. 19. A cable end 95 of the wire cable 78 on the one side is illustrated in a right part of FIG. 19. A cable end 96 of the wire cable 79 on the other side and a cable end 97 of the wire cable 79 on the one side are illustrated in left and right parts in FIG. 20, respectively. A cable end 98 of the wire cable 81 on the other side and a cable end 99 of the wire cable 81 on the one side are illustrated in left and right parts in FIG. 21, respectively.

In the disclosure, the drive gear can be returned to neutral based on a signal from the return switch. Therefore, the drive gear does not abut on immobile members defining a mechanical movable range. Accordingly, a situation in which an excess load current that may occur at the time of mechanical abutment flows in a control circuit of the motor and the control circuit is damaged can be avoided, and also the cost of the control circuit can be reduced.

In the disclosure, it is possible to satisfactorily prevent rainwater from penetrating into an interior side of an inner panel along wire cables.

In the disclosure, the shapes of cable ends are different from each other. Therefore, coupling portions of the cable ends and corresponding lever members have exclusive shapes that are exclusively coupled to each other and thus a coupling error can be prevented.

In the disclosure, even if a drive system of the power release mechanism causes an actuation failure due to immobilization or the like, a door-closing disabled state can be escaped by pulling a manual-cancellation wire cable. Furthermore, a manual emergency-operation unit is formed in an annular shape by turning back an end portion of a cable and thus can be reliably and easily operated.

In the disclosure, a configuration to return the drive gear to neutral with the return switch can be easily achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A vehicle-door opening and closing device comprising:

a latch unit configured to engage with a striker provided on a vehicle to keep a vehicle door in a half latched state and a fully latched state;

a power close mechanism configured to turn a latch of the latch unit to displace the vehicle door from the half latched state to the fully latched state;

a power release mechanism configured to release the fully latched state to bring the vehicle door to an openable state; and a drive gear configured to be driven by a motor to create a drive force, wherein the power release mechanism is configured to be actuated with the drive force of the drive gear, a return switch is placed near the drive gear, and configured to output a signal when the drive gear is driven from a first position to a second position to actuate the power release mechanism, the motor is configured to drive the drive gear from the second position to a third position based on the signal from the return switch, the latch unit is placed on a rear side of the vehicle door, a relay mechanism, operationally coupled to an open handle of the vehicle door, is placed on a front side of the vehicle door, the relay mechanism is coupled to the latch unit via a transmission unit including a first wire cable, and is configured to release the fully latched state by an operation of the open handle, the transmission unit further includes a second wire cable configured to transmit a drive force of the power release mechanism to the relay mechanism, and respective cable ends of the first wire cable and the second wire cable have different shapes.

2. The vehicle-door opening and closing device according to claim 1, wherein the motor is configured to drive the drive gear from the second position to the third position based only on the signal from the return switch.

3. The vehicle-door opening and closing device according to claim 1, wherein the first wire cable of the transmission unit is caused to pass through an inner panel of the vehicle door through a cable hole of the inner panel, and the first wire cable of the transmission unit includes a waterproof circular grommet that is fitted into the cable hole.

4. The vehicle-door opening and closing device according to claim 3, wherein shapes of cable ends of the first wire cable of the transmission unit are different from each other.

5. The vehicle-door opening and closing device according to claim 1, further comprising:

a ratchet-power-path open lever provided between the power release mechanism and the latch unit and configured to release operational coupling between the power release mechanism and the latch unit, wherein one side of a manual-cancellation wire cable is coupled to the ratchet-power-path open lever, and another side of the manual-cancellation wire cable has a manual emergency-operation unit formed in an annular shape by turning back a cable end of the manual-cancellation wire cable.

* * * * *